US011472529B2

(12) United States Patent
Miyashita

(10) Patent No.: US 11,472,529 B2
(45) Date of Patent: Oct. 18, 2022

(54) OUTBOARD ENGINE

(71) Applicant: SUZUKI MOTOR CORPORATION, Hamamatsu (JP)

(72) Inventor: Yasushi Miyashita, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 3 days.

(21) Appl. No.: 17/087,889

(22) Filed: Nov. 3, 2020

(65) Prior Publication Data

US 2021/0129964 A1 May 6, 2021

(30) Foreign Application Priority Data

Nov. 5, 2019 (JP) ..... JP2019-200572

(51) Int. Cl.

*B63H 20/12* (2006.01)
*B63H 20/06* (2006.01)
*B63H 20/10* (2006.01)

(52) U.S. Cl.

CPC ..... *B63H 20/12* (2013.01); *B63H 20/06* (2013.01); *B63H 20/10* (2013.01)

(58) Field of Classification Search

CPC ..... B63H 20/12; B63H 20/06; B63H 20/10
See application file for complete search history.

(56) References Cited

U.S. PATENT DOCUMENTS

| | | | | |
|---|---|---|---|---|
| 4,041,889 | A | 8/1977 | Blanchard | |
| 7,311,571 | B1 | 12/2007 | Swan et al. | |
| 2009/0084299 | A1* | 4/2009 | Mizutani | B63H 20/12 114/144 RE |
| 2009/0149091 | A1* | 6/2009 | Baros | B63H 20/10 440/61 T |

* cited by examiner

*Primary Examiner* — Stephen P Avila
(74) *Attorney, Agent, or Firm* — Holtz, Holtz & Volek PC

(57) ABSTRACT

A center of an actuator that rotates a steering shaft in side view of an outboard engine main body is at an outboard engine main body side from a clamp shaft supported by a clamp bracket and below the clamp shaft, and is further at a clamp shaft side from a steering shaft that is swingably supported by a swivel bracket that swings forward and backward with the outboard engine main body with the clamp shaft as a fulcrum. The center is located at the outboard engine main body side from an upper end mounting shaft where a tilt/trim unit that causes the swivel bracket to swing forward and backward with the clamp shaft as a fulcrum is connected to the swivel bracket and the tilt/trim unit is mounted and above the upper end mounting shaft.

4 Claims, 9 Drawing Sheets

OUTBOARD ENGINE

CROSS-REFERENCE TO RELATED APPLICATION

This application is based upon and claims the benefit of priority of the prior Japanese Patent Application No. 2019-200572, filed on Nov. 5, 2019, the entire contents of which are incorporated herein by reference.

BACKGROUND OF THE INVENTION

Field of the Invention

The present invention relates to an outboard engine.

Description of the Related Art

Among outboard engines, there is known an outboard engine including a clamp bracket that is mounted to a hull, and a swivel bracket that swings forward and backward with a clamp shaft supported by the clamp bracket as a fulcrum. The swivel bracket is mounted to an outboard engine main body, and swings forward and backward with the outboard engine main body, with the clamp shaft as the fulcrum. A steering shaft extending in an up-down direction is inserted into the swivel bracket. The steering shaft rotates (swings) integrally with the steering bracket and the outboard engine main body.

Conventionally, there has been proposed an outboard engine including a steering cylinder that is disposed in an upper part of the swivel bracket, above the clamp shaft, and rotates the steering shaft (for example, see U.S. Pat. No. 7,311,571).

Further, there has been also proposed an outboard engine in which a hydraulic cylinder disposed in a lower part of a swivel bracket causes a piston rack meshed with a pinion provided at the steering shaft to move reciprocally by hydraulic pressure and thereby rotates the steering shaft (for example, see U.S. Pat. No. 4,041,889).

When the actuator that rotates the steering shaft is disposed in the upper part of the swivel bracket, above the clamp shaft, as described above, the actuator greatly extends upward and to the left and right of the swivel bracket. Accordingly, in order to avoid contact with the actuator, the size of the outboard engine main body is limited. Further, it is difficult to form an arm portion extending forward, at the steering bracket, and it may become difficult to attach a tie bar that connects arm portions of the steering brackets of a plurality of outboard engines. Furthermore, when seawater is shut off by using a drive component, a boot or the like, the outboard engine is weak to contact and collision from outside. Further, there is the possibility of inflow of seawater when durability of the seal member is low.

When the actuator that rotates the steering shaft is disposed in the lower part of the swivel bracket as described above, the actuator is close to a water surface, and therefore, is easily affected by seawater or the like. Since the actuator is away from the clamp shaft, a moving amount of the actuator following a tilt operation and a trim operation of the outboard engine main body increases. Thereby, the actuator (including pipes of hydraulic pressure or the like connected to the actuator) easily deteriorates. Note that in the structure where the actuator that rotates the steering shaft is disposed between a transom of the hull and the outboard engine main body, serviceability (versatility) and marketability decline unless the influence of the shape or the like on the existing outboard engine main body is suppressed as much as possible. Consequently, a compact shape is required as well as a low-cost structure.

The present invention is made in view of the above circumstances, and has an object to provide an outboard engine in which an actuator that rotates a steering shaft can be compactly disposed, and durability of the actuator is secured.

SUMMARY OF THE INVENTION

An outboard engine of the present invention is an outboard engine including an outboard engine main body, a clamp bracket that is mounted to a hull, a clamp shaft that is supported by the clamp bracket, a swivel bracket that is fixed to the outboard engine main body, and swings forward and backward with the outboard engine main body with the clamp shaft as a fulcrum, a tilt/trim unit having a tilt cylinder that is connected to the swivel bracket and causes the swivel bracket to swing forward and backward with the clamp shaft as a fulcrum, a steering shaft that is swingably supported by the swivel bracket and is fixed to the outboard engine main body, and an actuator that rotates the steering shaft, wherein a center of the actuator in side view of the outboard engine main body is at an outboard engine main body side from the clamp shaft and below the clamp shaft, and further is located at a clamp shaft side from the steering shaft, and at the outboard engine main body side from an upper end mounting shaft for mounting the tilt/trim unit and above the upper end mounting shaft.

According to the present invention, the actuator that rotates the steering shaft can be compactly disposed. Further, the outboard engine that secures durability of the actuator can be realized.

DETAILED DESCRIPTION OF THE PREFERRED EMBODIMENT

Hereinafter, an outboard engine according to an embodiment of the present invention will be described with reference to the drawings.

Figure 1:
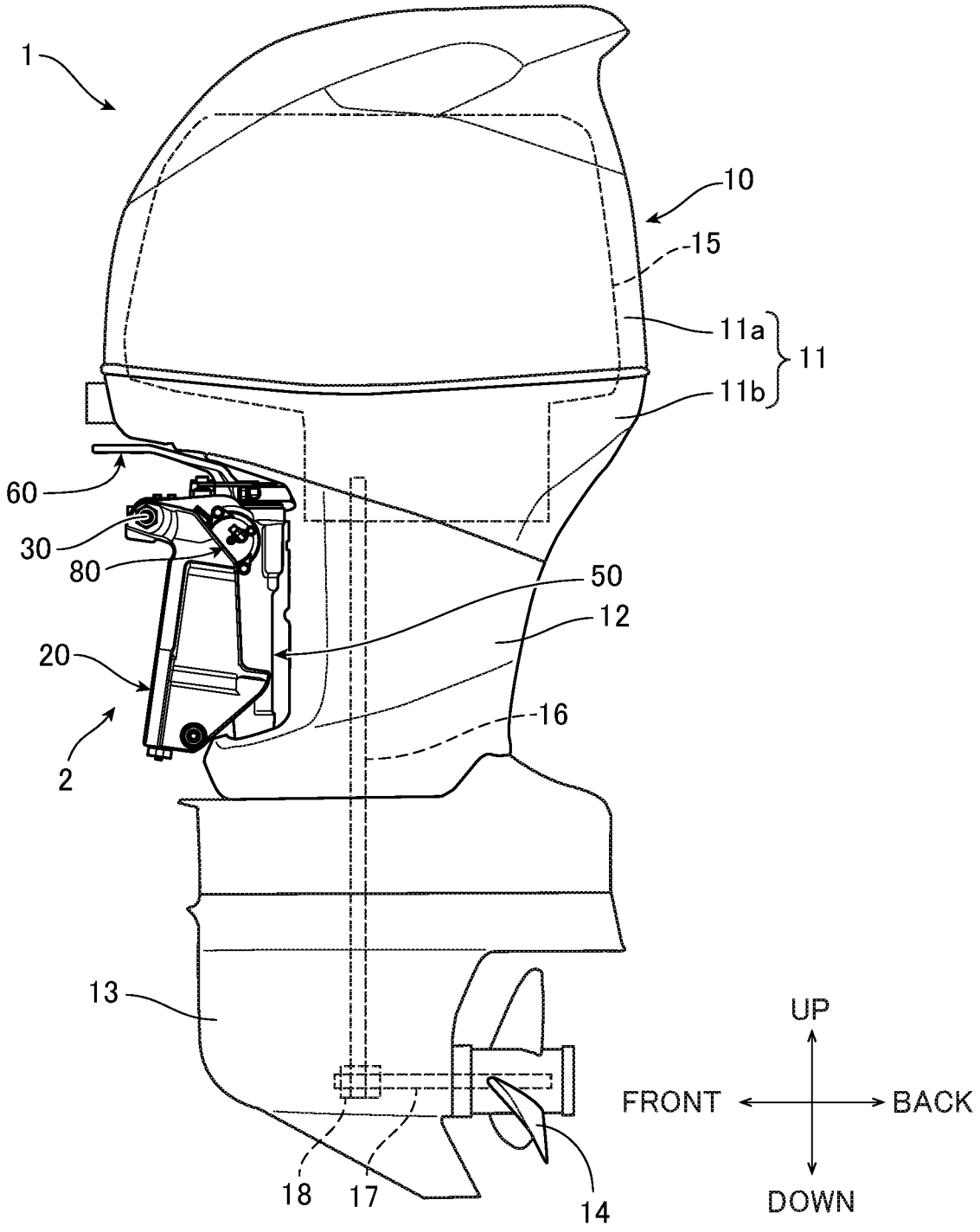
FIG. 1 is a side view illustrating an outboard engine according to an embodiment of a present invention.

FIG. 1 is a side view illustrating an outboard engine 1 according to the embodiment of the present invention.

Figure 2:
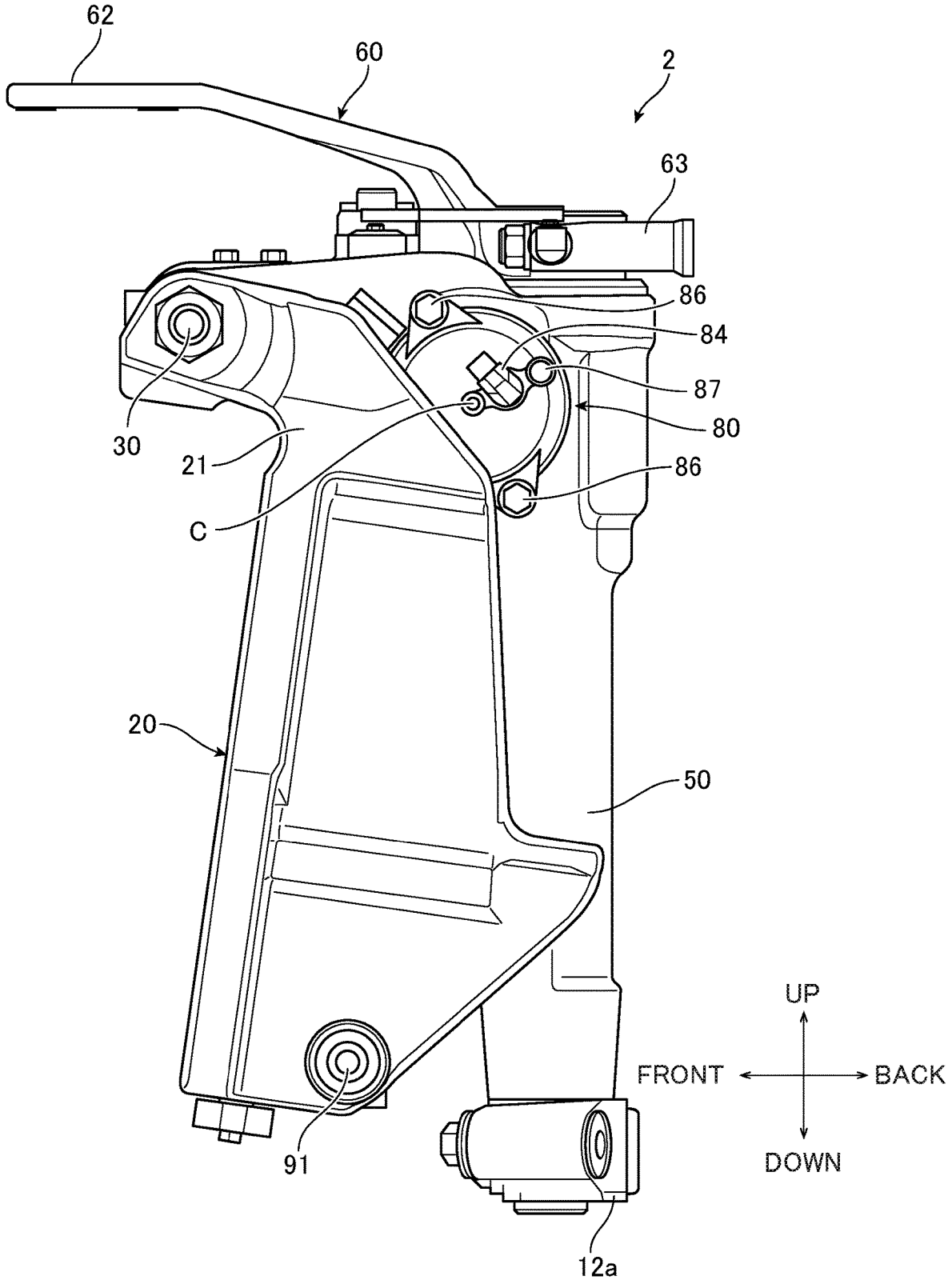
FIG. 2 is a side view illustrating a mounting device of an outboard engine main body according to the embodiment of the present invention.
Figure 3:
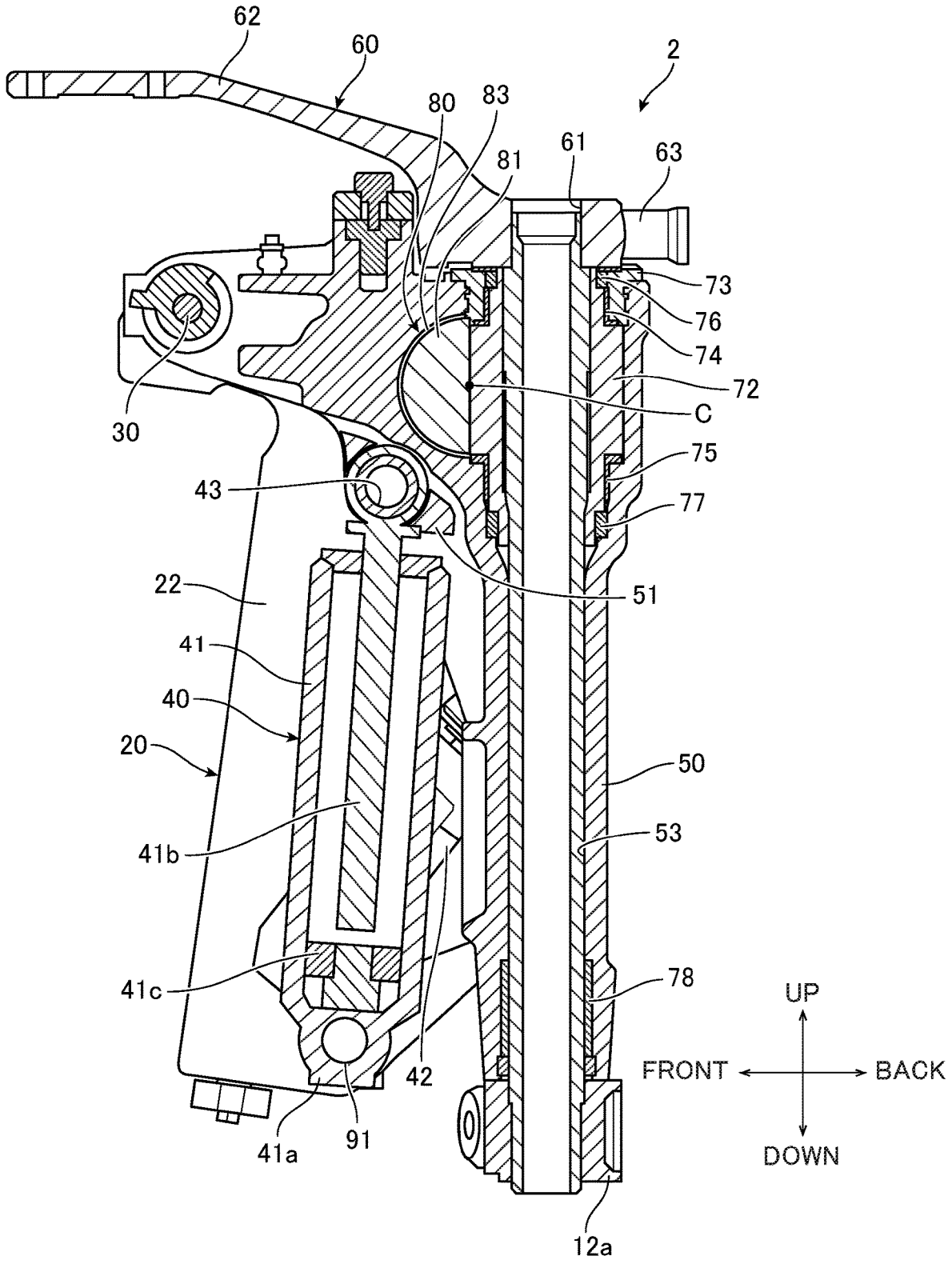
FIG. 3 is a sectional view illustrating the mounting device of the outboard engine main body according to the embodiment of the present invention.

FIG. 2 and FIG. 3 are a side view and a sectional view each illustrating a mounting device 2 of an outboard engine main body 10.

Figure 4:
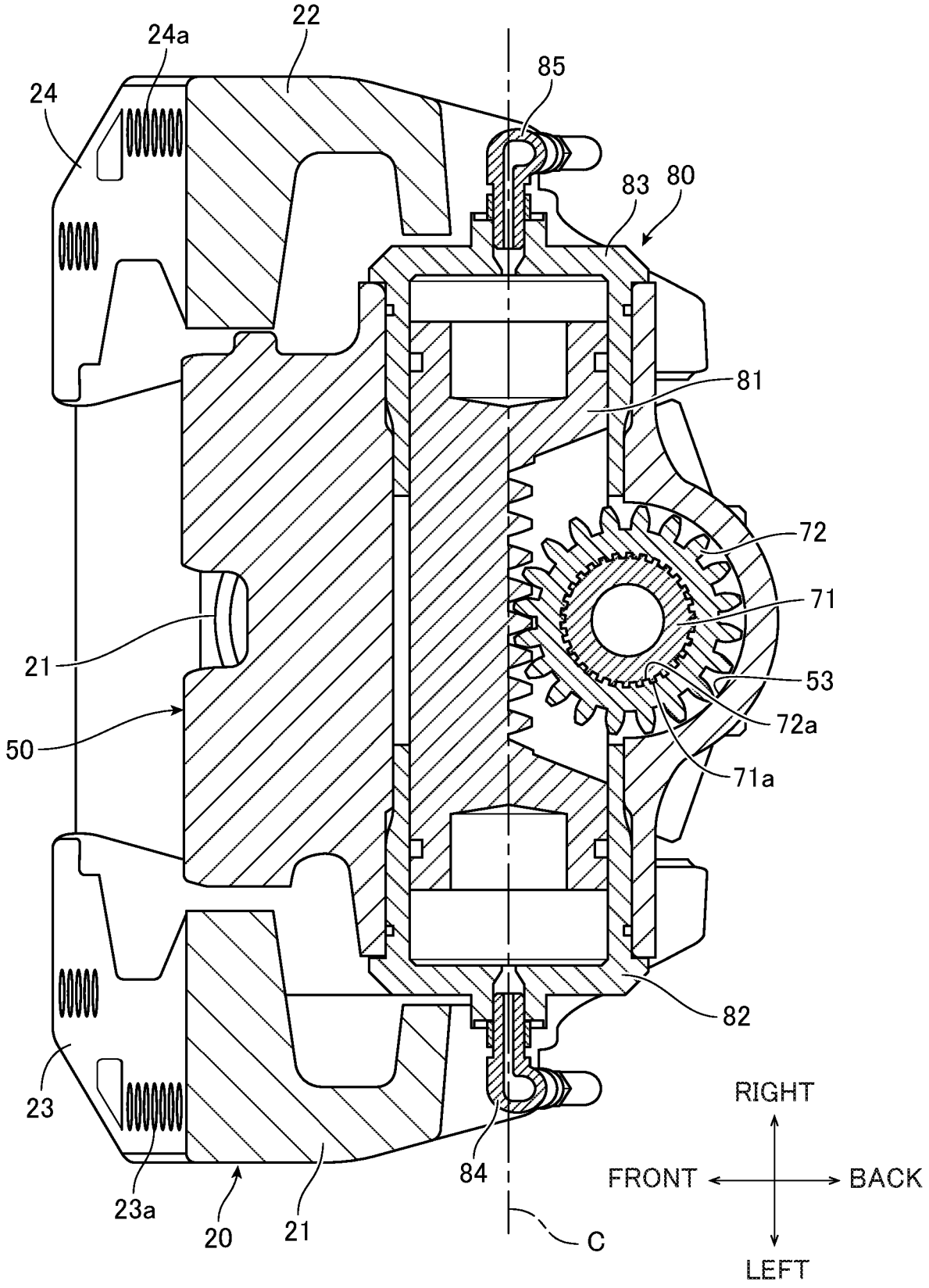
FIG. 4 is a sectional view illustrating a hydraulic cylinder and the like of the outboard engine according to the embodiment of the present invention.

FIG. 4 is a sectional view illustrating a hydraulic cylinder 80 and the like.

Figure 5:
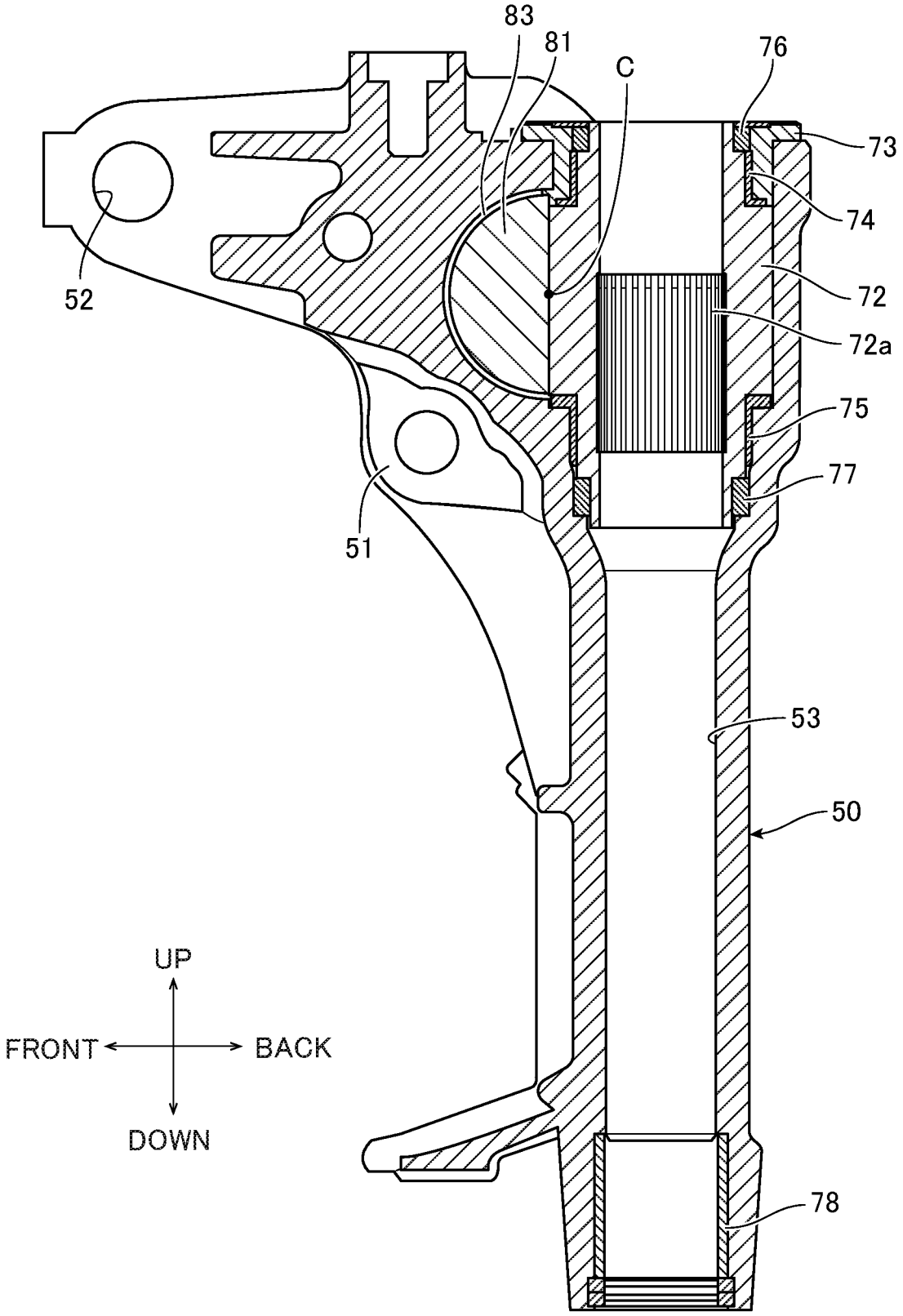
FIG. 5 is a sectional view illustrating a swivel bracket and the like in a state where a steering shaft of the outboard engine according to the embodiment of the present invention is taken out.

FIG. 5 is a sectional view illustrating a swivel bracket 50 and the like in a state where a steering shaft 71 is taken out.

Figure 6:
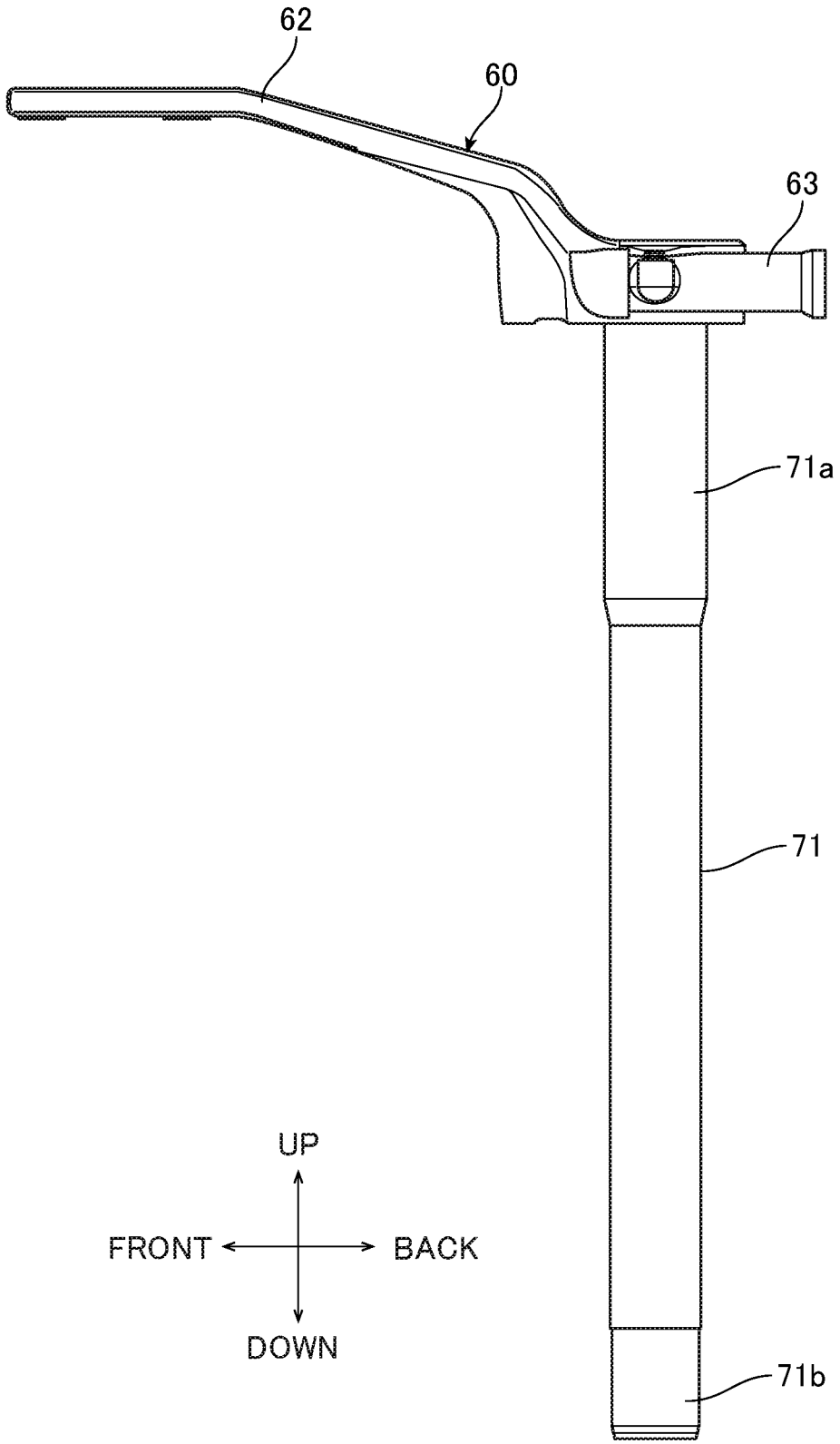
FIG. 6 is a side view illustrating a steering bracket and the steering shaft in the embodiment of the present invention.

FIG. 6 is a side view illustrating a steering bracket 60 and the steering shaft 71.

Figure 7:
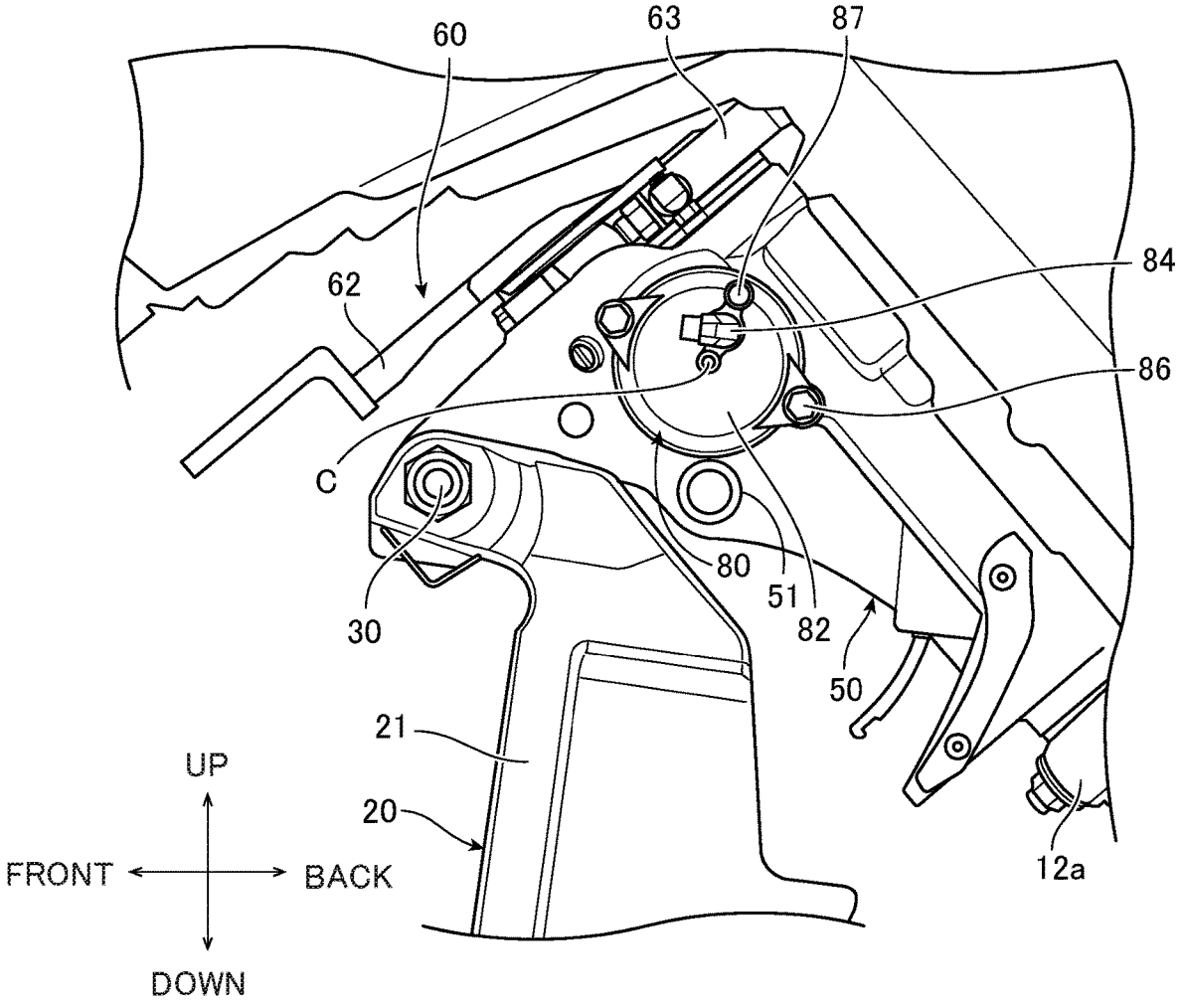
FIG. 7 is a side view illustrating a swivel bracket and the like in a state where the outboard engine main body is tilted at a predetermined angle, in the embodiment of the present invention.

FIG. 7 is a side view illustrating a swivel bracket 50 and the like in a state where the outboard engine main body 10 is tilted at a predetermined angle.

The outboard engine 1 illustrated in FIG. 1 is a ship propulsion device that is mounted to a stern that is a rear part of a hull of a ship. While the outboard engine 1 can change a direction in a front-back direction and a left-right direction with respect to the hull, in FIG. 1 to FIG. 7 and FIG. 8 and FIG. 9 described later, a rotation shaft (propeller shaft 17) of a propeller 14 in the outboard engine 1 in an initial state of being mounted to the hull is defined as a front-back direction, and respective directions of front and back, up and down, and left and right that are orthogonal to one another are indicated by arrows. Note that a front is a hull side, and a back is an outboard engine 1 side. Further, a right is a right hand side to the hull side from the outboard engine 1, and a left is a left hand side.

The outboard engine 1 includes the outboard engine main body 10 and the mounting device 2. The mounting device 2 has a clamp bracket 20, a clamp shaft 30, the swivel bracket 50, the steering bracket 60, a hydraulic cylinder 80 and the like.

The outboard engine main body 10 has an engine cover 11, a drive shaft housing 12, a lower housing 13, the propeller 14, an engine 15, a drive shaft 16, the propeller shaft 17, and a bevel mechanism 18.

The engine cover 11 has an upper cover 11*a* and a lower cover 11*b*. The engine cover 11 covers the engine 15 that drives the propeller 14 that is mounted to the lower housing 13 so that the engine 15 is in a hermetically sealed state. The drive shaft 16 of the engine 15 extends to an inside of the lower housing 13 through an inside of the drive shaft housing 12, and transmits power to the propeller shaft 17 connected to the propeller 14 via the bevel gear mechanism 18. A propulsive force by the outboard engine 1 is generated by the propeller 14 rotating.

As illustrated in FIG. 4, the clamp bracket 20 has a left bracket 21 and a right bracket 22. The left bracket 21 and the right bracket 22 are respectively provided with mounting portions 23 and 24 each in a planar shape for mounting the clamp bracket 20 to a back end (transom) of the aforementioned hull. The mounting portions 23 and 24 are respectively provided with a plurality of mounting holes 23*a* and 24*a*. A height position of the clamp bracket 20 (outboard engine 1) to the hull can be adjusted by mounting the mounting portions 23 and 24 to the back end of the hull with bolts in arbitrary mounting holes 23*a* and 24*a* of the plurality of mounting holes 23*a* and 24*a*.

The left bracket 21 and the right bracket 22 support the clamp shaft 30 illustrated in FIG. 2 and FIG. 3. The clamp shaft 30 is inserted into a pair of left and right clamp shaft insertion holes 52 of the swivel bracket 50 illustrated in FIG. 5 and described later, and serves as a fulcrum of forward and backward swing of the swivel bracket 50. The left bracket 21 and the right bracket 22 support a lower shaft 91 in lower ends.

A tilt/trim unit 40 illustrated in FIG. 3 has a tilt cylinder 41, a pair of left and right trim cylinders 42 (only a part of a trim cylinder 42 on a right side is illustrated), and an upper end mounting shaft 43 of the tilt/trim unit 40.

The tilt cylinder 41 has a bearing portion 41*a*, a piston rod 41*b*, and a piston 41*c*.

The bearing portion 41*a* supports the lower shaft 91 between a lower end of the left bracket 21 and a lower end of the right bracket 22.

The piston 41*c* advances and retreats the piston rod 41*b* up and down by sliding in the tilt cylinder 41 by hydraulic pressure, and makes a position of the upper end mounting shaft 43 connected to an upper end of the piston rod 41*b* to the lower shaft 91 changeable.

The upper end mounting shaft 43 is inserted into a pair of left and right mounting bearing portions 51 of the swivel bracket 50 illustrated in FIG. 5. Therefore, the swivel bracket 50 swings forward and backward with the clamp shaft 30 as a fulcrum by the position of the upper end mounting shaft 43 to the lower shaft 91 changing by operation of the tilt cylinder 41. The swivel bracket 50 is connected to the outboard engine main body 10 via a steering shaft 71 that is rotatably inserted in a steering shaft insertion hole 53, and the steering bracket 60. Therefore, the outboard engine main body 10 also swings in the front-back direction with the swivel bracket 50, with the clamp shaft 30 as the fulcrum by the operation of the tilt cylinder 41.

Note that swing of the outboard engine main body 10 that is performed by drive of the tilt cylinder 41 is referred to as a tilt operation, and swing of the outboard engine main body 10 that is performed by drive of the trim cylinder 42 is referred to as a trim operation. The tilt operation is performed in a case where the outboard engine main body 10 is greatly tilted and a part including the propeller 14 is raised on a water surface while the ship is stopped or when the hull is unloaded, or the like. The trim operation is performed in a case where a tilt angle (trim angle) of the outboard engine main body 10 in the up-down direction is adjusted to change a traveling attitude in a state where the propeller 14 is under water, or the like. The pair of left and right trim cylinders 42 that operate to perform the trim operation also cause the swivel bracket 50, the outboard engine main body 10 by extension in the front-back direction. Note that the pair of left and right trim cylinders 42 are located on both a left and right sides of the tilt cylinder 41, but as described above, FIG. 3 illustrates only a part of the trim cylinder 42 on the right side.

As illustrated in FIG. 3, the steering bracket 60 has a steering shaft mounting hole 61 into which the steering shaft 71 is inserted and fixed. Further, the steering bracket 60 has an arm 62 that extends forward from the steering shaft mounting hole 61. The steering bracket 60 has a pair of left and right connection portions 63 that extend backward from the steering shaft mounting hole 61. The connection portions 63 are fixed to the outboard engine main body 10 with bolts and nuts. A lower end of the steering shaft 71 protrudes downward from the steering shaft insertion hole 53 of the swivel bracket 50 and is fixed to the outboard engine main boy 10 in a mounting portion 12*a*.

The steering bracket 60 is fixed to the steering shaft 71, and therefore swings integrally with the steering shaft 71.

Further, since the steering bracket 60 is fixed to the outboard engine main body 10 in the connection portions 63, and the steering shaft 71 is fixed to the outboard engine main body 10 in the mounting portion 12*a*, the outboard engine main body 10 turns (swings) left and right by rotation of the steering shaft 71.

The hydraulic cylinder 80 is an example of an actuator that rotates the steering shaft 71. The actuator may be another actuator such as a motor as long as the actuator rotates the steering shaft 71.

As illustrated in FIG. 4, the hydraulic cylinder 80 has a piston rack 81, a left cylinder body 82, a right cylinder body 83, a left nipple 84 and a right nipple 85.

The piston rack 81 is disposed between the left cylinder body 82 and the right cylinder body 83. The piston rack 81 slides in the left cylinder body 82 and the right cylinder body 83 in the left-right direction by hydraulic pressure. Note that oil in the hydraulic cylinder 80 can be supplied from pipes connected to the left cylinder body 82 and the right cylinder body 83 via the left nipple 84 and the right nipple 85.

A rear portion of the piston rack 81 is meshed with a pinion 72 provided at an upper part of the steering shaft 71. Therefore, the steering shaft 71 rotates (swings) by the piston rack 81 sliding in the left-right direction in the left cylinder body 82 and the right cylinder body 83. Note that a spline 72*a* that is meshed with an upper spline 71*a* provided on an outer peripheral surface of the steering shaft 71 is formed on an inner peripheral surface of the pinion 72, and thereby the steering shaft 71 and the pinion 72 are fixed. In this manner, the steering shaft 71 and the pinion 72 can be fixed with splines, serrations and the like.

As illustrated in FIG. 6, in the upper spline 71*a*, a length in a longitudinal direction (up-down direction) of the steering shaft 71 is longer than a length of the lower spline 71*b* that is mounted to the mounting portion 12*a* (drive shaft housing 12) in the lower end of the steering shaft 71. Further, a diameter of the upper spline 71*a* is larger than a diameter of the lower spline 71*b*. Therefore, the steering shaft 71 is inserted into the steering shaft insertion hole 53 from above, and a lower end of the upper spline 71*a* can be supported by the steering shaft insertion hole 53 via the pinion 72.

The left cylinder body 82 and the right cylinder body 83 illustrated in FIG. 4 are, for example, screwed and inserted inside the swivel bracket 50. The left cylinder body 82 is fixed to the swivel bracket 50 by two bolts 86, for example, illustrated in FIG. 2. The right cylinder body 83 is also fixed to the swivel bracket 50 by bolts similarly to the left cylinder body 82.

As illustrated in FIG. 3, a center C (illustrated by an alternate long and short dashed lines in FIG. 4, and by a dot in FIG. 3 and FIG. 5) of the hydraulic cylinder 80 in side view of the outboard engine main body 10 is located at a back side (outboard engine main body 10 side) and below the clamp shaft 30 (center of the clamp shaft 30), and is at a front side (clamp shaft 30 side) from the steering shaft 71. The center C is located at a back side (outboard engine main body 10 side) from the upper end mounting shaft 43 (center of the upper end mounting shaft 43), and above the upper end mounting shaft 43. Note that as illustrated in FIG. 2, in a state where the outboard engine main body 10 does not tilt, a part of the hydraulic cylinder 80 is located between the left bracket 21 and the right bracket 22 (space in the clamp bracket 20) in the left-right direction.

The left nipple 84 (and the right nipple 85) extends diagonally along a close upper portion of the left bracket 21 (right bracket 22) in the state where the swivel bracket 50 and the outboard engine main body 10 do not tilt as illustrated in FIG. 2, and thereby makes the hydraulic cylinder 80 compact. Note that in FIG. 2, the left nipple 84 is fixed to the left cylinder body 82 in a position offset from the center C of the hydraulic cylinder 80. In FIG. 4, the left nipple 84 is fixed to the center C of the hydraulic cylinder 80, and extends diagonally downward to the outboard engine main body 10 side unlike FIG. 2, but either of arranging positions and orientations may be adopted. Hydraulic pressure supply to the hydraulic cylinder 80 can be enabled from an arbitrary position (for example, a hull side) via the pipes connected to the left nipple 84 and the right nipple 85. Further, as illustrated in FIG. 4, a length in the left-right direction of the hydraulic cylinder 80 including the left nipple 84 and the right nipple 85 is shorter than a length in the left-right direction of the clamp bracket 20. This makes it difficult for the left nipple 84 and the right nipple 85 to interfere with work of mounting the clamp bracket 20 to the hull. As illustrated in FIG. 7, in a state where the swivel bracket 50 and the outboard engine main body 10 tilt at a predetermined angle (for example, approximately 40°) by operation of the tilt/trim unit 40, an air vent 87 provided in the hydraulic cylinder 80 is located at an uppermost portion of the hydraulic cylinder 80 (left cylinder body 82). Further, the left nipple 84 extends forward horizontally above the center C of the hydraulic cylinder 80. Note that in FIG. 7, illustration of the tilt/trim unit 40 is omitted.

As illustrated in FIG. 3 and FIG. 5, a cap 73 is screwed into the swivel bracket 50 in a state where the pinion 72 is inserted into the steering shaft insertion hole 53 of the swivel bracket 50 from above, and thereby a gap between the pinion 72 and the swivel bracket 50 is closed. Further, a bush 74 that is a bearing having a brim at a lower end is disposed on an outer peripheral surface of an upper small-diameter portion of the pinion 72. The bush 74 receives a thrust reaction force, a lift reaction force, a self-weight and the like of the engine 15 (outboard engine main body 10). Further, a bush 75 that is a bearing having a brim at an upper end is disposed on an outer peripheral surface of a lower small-diameter portion of the pinion 72. An upper seal 76 is disposed between an inner peripheral surface of the cap 73 and an outer peripheral surface of an upper end of the pinion 72, and a lower seal 77 is disposed between an outer peripheral surface of a lower end of the pinion 72 and an inner peripheral surface of the swivel bracket 50 (steering shaft insertion hole 53). Thereby, the hydraulic cylinder 80 is easily mounted to an inside of the swivel bracket 50 by screwing the cap 73, and the hydraulic cylinder 80 is hermetically sealed. Note that a lower bush 78 is disposed on an inner peripheral surface of a lower end of the swivel bracket 50 (steering shaft insertion hole 53).

Figure 8:
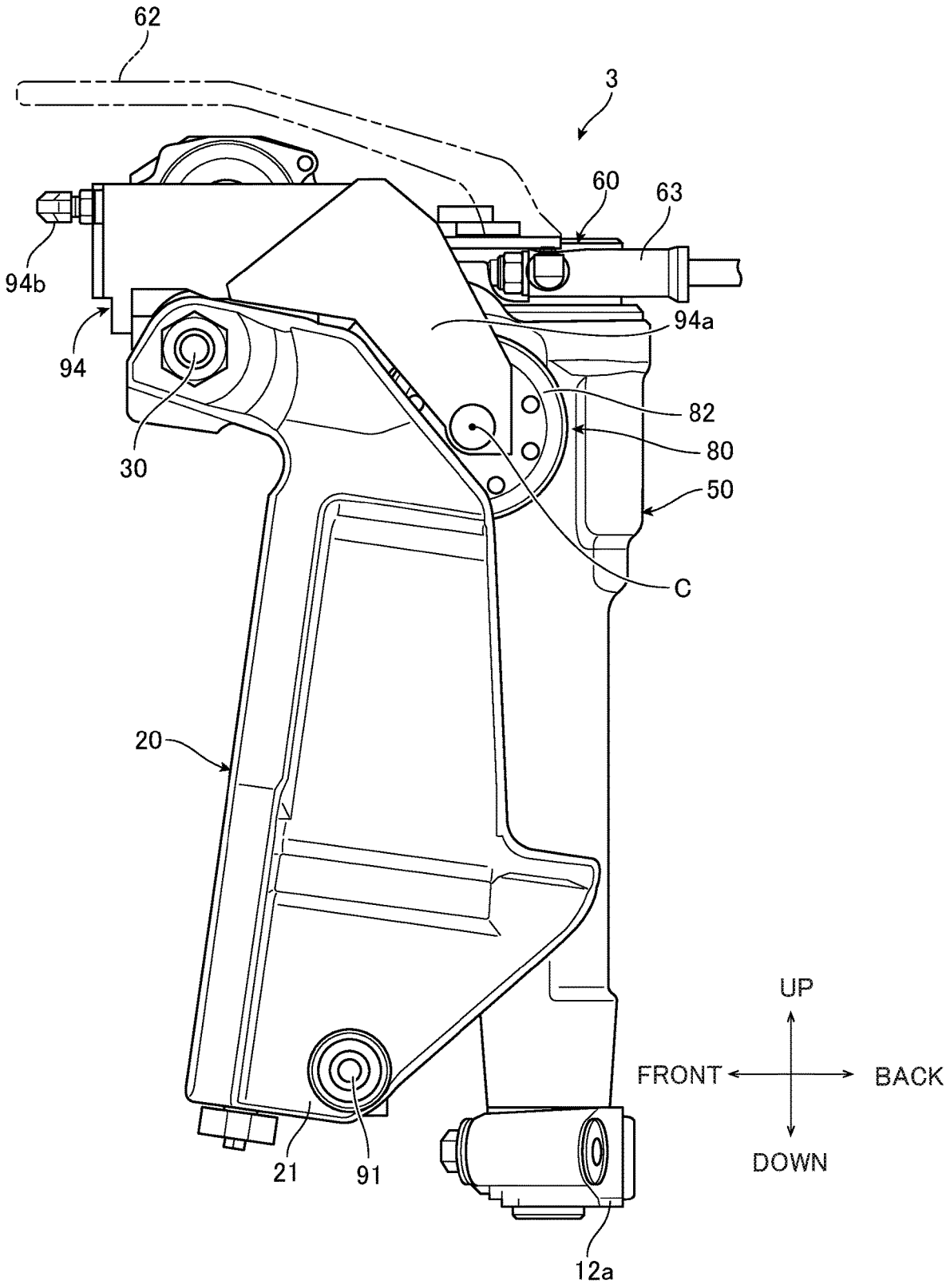
FIG. 8 is a side view illustrating a mounting device of an outboard engine main body in a modification of the present invention.
Figure 9:
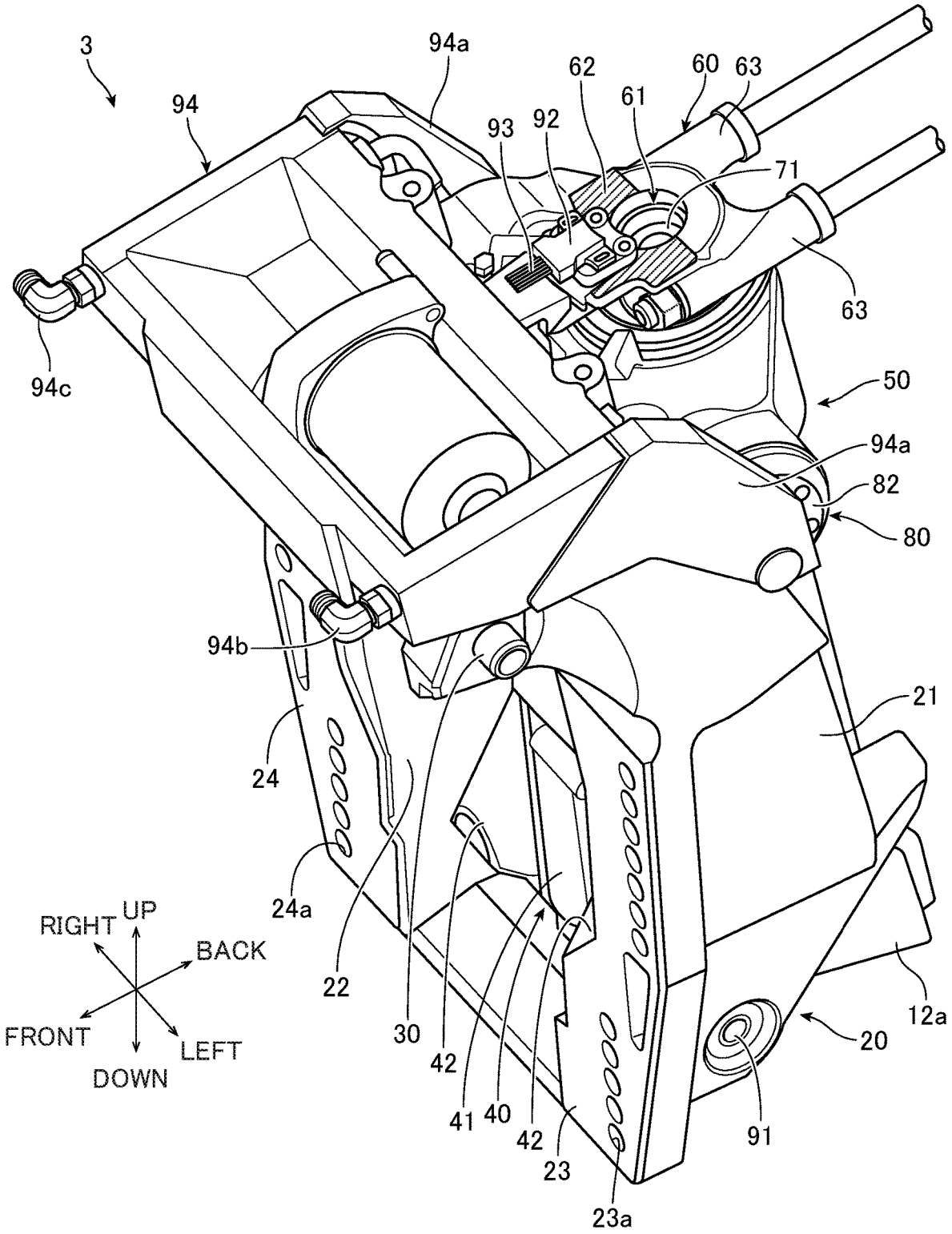
FIG. 9 is a perspective view illustrating the mounting device of the outboard engine main body in the modification of the present invention.

FIG. 8 and FIG. 9 are side views each illustrating a mounting device 3 of an outboard engine main body 10 in a modification.

As illustrated in FIG. 8, a hydraulic pump 94 that supplies hydraulic pressure to a hydraulic cylinder 80 is located above a clamp shaft 30 and below a steering bracket 60 (arm 62), and can be fixed to a swivel bracket 50, for example. Note that in FIG. 9, illustration of an arm 62 of the steering bracket 60 is omitted. As illustrated in FIG. 9, the hydraulic pump 94 has a pair of left and right arms 94*a* that are fixed to a hydraulic cylinder 80, and supplies oil to the hydraulic cylinder 80 via a pipe not illustrated and located inward in a left-right direction from the pair of left and right arms 94*a*, for example. Further, at the hydraulic pump 94, nipples 94*b* and 94*c* that are connected to the pipe for oil protrude forward from a left and a right of a front end at a hull side and extends to face rightward.

As illustrated in FIG. 9, a swing amount (turning angle) of the steering bracket 60 is detected by a rudder angle sensor 92. A detection result of the rudder angle sensor 92 is acquired by a control unit not illustrated via wiring 93. The control unit can perform drive control of the hydraulic cylinder 80 based on the detection result of the rudder angle sensor 92.

In the present embodiment described above, the outboard engine 1 includes the outboard engine main body 10, the clamp bracket 20, the clamp shaft 30, the tilt/trim unit 40, the swivel bracket 50, the steering shaft 71, and the hydraulic cylinder 80 that is an example of the actuator. The clamp bracket 20 is mounted to a hull. The clamp shaft 30 is supported by the clamp bracket 20. The swivel bracket 50 is fixed to the outboard engine main body 10, and swings forward and backward with the outboard engine main body 10, with the clamp shaft 30 as the fulcrum. The tilt/trim unit 40 has the tilt cylinder 41. The tilt cylinder 41 is connected to the swivel bracket 50 in the upper end mounting shaft 43, and causes the swivel bracket 50 to swing forward and backward with the clamp shaft 30 as the fulcrum. The steering shaft 71 is swingably supported by the swivel bracket 50, and is fixed to the outboard engine main body 10. The hydraulic cylinder 80 rotates the steering shaft 71. The center C of the hydraulic cylinder 80 in side view of the outboard engine main body 10 is at the outboard engine main body 10 side (back side) from the clamp shaft 30 and below the clamp shaft 30, and is at the clamp shaft 30 side (front side) from the steering shaft 71. Further, the center C is located at the outboard engine main body 10 side (back side) from the upper end mounting shaft 43 and above the upper end mounting shaft 43.

Thereby, the hydraulic cylinder 80 can be assembled with a simple structure inside an upper part of the swivel bracket 50 as compared with a mode in which the hydraulic cylinder 80 is disposed in the swivel bracket 50 above the clamp shaft 30, and therefore, cost of the hydraulic cylinder 80 can be reduced. Further, since the hydraulic cylinder 80 can be disposed compactly, it is also possible to avoid the shape of the outboard engine main body 10 from being limited. Thereby, it is also possible to mount the hydraulic cylinder 80 (swivel bracket 50) to the existing outboard engine main body 10 easily, and therefore the present invention is also excellent in serviceability. Since the arm portion 62 extending forward is easily formed at the steering bracket 60, it becomes easy to attach a tie bar that connects the arm portions 62 of the steering brackets 60 of a plurality of outboard engines 1. Since the hydraulic cylinder 80 is disposed inside the upper part of the swivel bracket 50, the hydraulic cylinder 80 hardly receives seawater while the ship is traveling, and is strong to contact and collision from outside.

Further, as compared with a mode where the hydraulic cylinder 80 is disposed in a lower part of the swivel bracket 50, the hydraulic cylinder 80 is apart from a water surface, and is hardly affected by seawater or the like including when the ship is at anchor. Further, a distance from the clamp shaft 30 to be the swing fulcrum is short, a moving amount of the hydraulic cylinder 80 following the tilt operation and the trim operation of the outboard engine main body 10 decreases. Accordingly, durability of the hydraulic cylinder 80 (including the pipes connected to the left nipple 84 and the right nipple 85) can be improved.

As above, according to the present embodiment, it is possible to dispose the hydraulic cylinder 80 that rotates the steering shaft 71 compactly and to improve durability of the hydraulic cylinder 80, and it is possible to realize the outboard engine 1 including durability.

Further, in the present embodiment, the hydraulic cylinder 80 is a hydraulic cylinder that operates the piston rack 81 meshed with the pinion 72 provided at the steering shaft 71 by hydraulic pressure. Therefore, it is possible to dispose the actuator (hydraulic cylinder 80) that rotates the steering shaft 71 compactly. Note that it is also possible to improve durability and reliability of the piston rack 81 and the pinion 72 by the inside of the hydraulic cylinder 80 being filled with oil.

Further, in the present embodiment, the hydraulic cylinder 80 has the air vent 87 that is located at the uppermost portion of the hydraulic cylinder 80 in the state where the swivel bracket 50 and the outboard engine main body 10 tilt at a predetermined angle by operation of the tilt/trim unit 40. Therefore, the air vent 87 is away from the water surface, and thereby is hardly affected by seawater or the like.

Further, in the modification of the present embodiment, the outboard engine 1 includes the steering bracket 60 and the hydraulic pump 94. The steering bracket 60 is fixed to the steering shaft 71, and swings left and right with the outboard engine main body 10. The hydraulic pump 94 is located above the clamp shaft 30 and below the steering bracket 60 (arm 62), and supplies hydraulic pressure to the hydraulic cylinder 80. Further, as described above, the center C of the hydraulic cylinder 80 is located at the outboard engine main body 10 side (back side) from the clamp shaft 30 and below the clamp shaft 30. Accordingly, it is possible to dispose the hydraulic pump 94 between the steering bracket 60 and the clamp shaft 30.

Further, the present embodiment has the structure in which the clamp bracket 20 is the left bracket 21 and the right bracket 22 that support the clamp shaft 30 at both the left and right sides of the swivel bracket 50, and at least a part of the hydraulic cylinder 80 is located between the left bracket 21 and the right bracket 22 in the state where the outboard engine main body 10 does not tilt. Therefore, the hydraulic cylinder 80 can be compactly disposed.

Note that the present invention can be carried out by being variously changed without being limited to the above described embodiment. It is possible to properly change the components, control and the like illustrated in the accompanying drawings within the range in which the effect of the present invention is exhibited without being limited to the components, control and the like illustrated in the accompanying drawings. In addition, it is possible to carry out the present invention by properly changing the present invention within the range without departing from the object of the present invention.

REFERENCE SIGNS LIST

1: outboard engine
2, 3: mounting device
10: outboard engine main body
11: engine cover
11*a*: upper cover
11*b*: lower cover
12: drive shaft housing
12*a*: mounting portion
13: lower housing
14: propeller
15: engine
16: drive shaft
17: propeller shaft

18: bevel mechanism
20: clamp bracket
21: left bracket
22: right bracket
23, 24: mounting portion
23*a*, 24*a*: mounting hole
30: clamp shaft
40: tilt/trim unit
41: tilt cylinder
41*a*: bearing portion
41*b*: piston rod
41*c*: piston
42: trim cylinder
43: upper end mounting shaft
50: swivel bracket
51: mounting bearing portion
52: clamp shaft insertion hole
53: steering shaft insertion hole
60: steering bracket
61: steering shaft mounting hole
62: arm
63: connection portion
71: steering shaft
71*a*: upper spline
71*b*: lower spline
72: pinion
72*a*: spline
73: cap
74, 75: bush
76: upper seal
77: lower seal
78: lower bush
80: hydraulic cylinder
81: piston rack
82: left cylinder body
83: right cylinder body
84: left nipple
85: right nipple
86: bolt
87: air vent
91: lower shaft
92: rudder angle sensor
93: wiring
94: hydraulic pump
94*a*: arm
94*b*, 94*c*: nipple

What is claimed is:

1. An outboard engine, comprising:
an outboard engine main body;
a clamp bracket that is mountable to a hull;
a clamp shaft that is supported by the clamp bracket;
a swivel bracket that is fixed to the outboard engine main body, and swings forward and backward with the outboard engine main body with the clamp shaft as a fulcrum;
a tilt/trim unit having a tilt cylinder that is connected to the swivel bracket and causes the swivel bracket to swing forward and backward with the clamp shaft as a fulcrum;
a steering shaft that is swingably supported by the swivel bracket, and is fixed to the outboard engine main body; and
an actuator that rotates the steering shaft,
wherein a center of the actuator, as viewed in a side view of the outboard engine main body, is located at a position that is (i) between the steering shaft and the clamp shaft, (ii) lower than the clamp shaft, (iii) between the steering shaft and an upper end mounting shaft for mounting the tilt/trim unit, and (iv) higher than the upper end mounting shaft, and
wherein the actuator comprises a hydraulic cylinder that operates a piston rack meshed with a pinion provided at the steering shaft by hydraulic pressure.

2. The outboard engine according to claim 1, wherein the hydraulic cylinder includes an air vent that is located at an uppermost portion of the hydraulic cylinder in a state where the swivel bracket and the outboard engine main body tilt at a predetermined angle by operation of the tilt/trim unit.

3. An outboard engine, comprising:
an outboard engine main body;
a clamp bracket that is mountable to a hull;
a clamp shaft that is supported by the clamp bracket;
a swivel bracket that is fixed to the outboard engine main body, and swings forward and backward with the outboard engine main body with the clamp shaft as a fulcrum;
a tilt/trim unit having a tilt cylinder that is connected to the swivel bracket and causes the swivel bracket to swing forward and backward with the clamp shaft as a fulcrum;
a steering shaft that is swingably supported by the swivel bracket, and is fixed to the outboard engine main body;
an actuator that rotates the steering shaft;
a steering bracket that is fixed to the steering shaft, and swings left and right with the outboard engine main body; and
a hydraulic pump that is located above the clamp shaft and below the steering bracket and supplies hydraulic pressure to the actuator,
wherein a center of the actuator, as viewed in a side view of the outboard engine main body, is located at a position that is (i) between the steering shaft and the clamp shaft, (ii) lower than the clamp shaft, (iii) between the steering shaft and an upper end mounting shaft for mounting the tilt/trim unit, and (iv) higher than the upper end mounting shaft.

4. An outboard engine, comprising:
an outboard engine main body;
a clamp bracket that is mountable to a hull;
a clamp shaft that is supported by the clamp bracket;
a swivel bracket that is fixed to the outboard engine main body, and swings forward and backward with the outboard engine main body with the clamp shaft as a fulcrum;
a tilt/trim unit having a tilt cylinder that is connected to the swivel bracket and causes the swivel bracket to swing forward and backward with the clamp shaft as a fulcrum;
a steering shaft that is swingably supported by the swivel bracket, and is fixed to the outboard engine main body; and
an actuator that rotates the steering shaft,
wherein:
a center of the actuator, as viewed in a side view of the outboard engine main body, is located at a position that is (i) between the steering shaft and the clamp shaft, (ii) lower than the clamp shaft, (iii) between the steering shaft and an upper end mounting shaft for mounting the tilt/trim unit, and (iv) higher than the upper end mounting shaft,
the clamp bracket comprises a left bracket and a right bracket that support the clamp shaft on both left and right sides of the swivel bracket, and at least a part of the actuator is located between the left bracket and the right bracket in a state where the outboard engine main body does not tilt.

* * * * *